United States Patent [19]
Mathewson et al.
[11] 4,227,283
[45] Oct. 14, 1980

[54] INTEGRAL HINGE STRUCTURE

[75] Inventors: James A. Mathewson, Raleigh; Harry Pasterchick, Jr., Cary, both of N.C.

[73] Assignee: International Business Machines Corporation, Armonk, N.Y.

[21] Appl. No.: 747

[22] Filed: Jan. 3, 1979

[51] Int. Cl.² ..... E05D 9/00
[52] U.S. Cl. ..... 16/128 R; 16/191; 220/338
[58] Field of Search ..... 16/172, 171, 149, 191, 16/DIG. 13, 161, 173, 174, 136, 128; 220/337, 338

[56] References Cited

U.S. PATENT DOCUMENTS

| | | | |
|---|---|---|---|
| 67,889 | 8/1867 | Lane | 16/172 |
| 880,757 | 3/1908 | Rugg | 16/172 |
| 2,732,581 | 1/1956 | Heck | 16/174 |
| 3,141,190 | 7/1964 | Reiss | 16/136 |
| 3,349,430 | 10/1967 | Rosenvold et al. | 16/136 |
| 3,463,109 | 8/1969 | Weiler | 16/171 |

*Primary Examiner*—George H. Krizmanich
*Attorney, Agent, or Firm*—Gerald R. Woods

[57] ABSTRACT

An integral hinge structure for securing a cover to a terminal base includes a generally cylindrical strip of material extending along one edge of an opening to be covered. The cylindrical strip is integral with the base but is spaced from the base by a thin, continuous neck. The cover includes a generally C-shaped strip of material circumscribing an arc of at least 180°. The outer diameter of the cylindrical strip and the inner diameter of the C-shaped strip are approximately the same, allowing the C-shaped strip to be snapped onto and retained by the cylindrical strip. The cover is aligned by one or more radial ribs on the cylindrical strip and one or more complementary slots in the C-shaped strip.

7 Claims, 6 Drawing Figures

FIG. 3
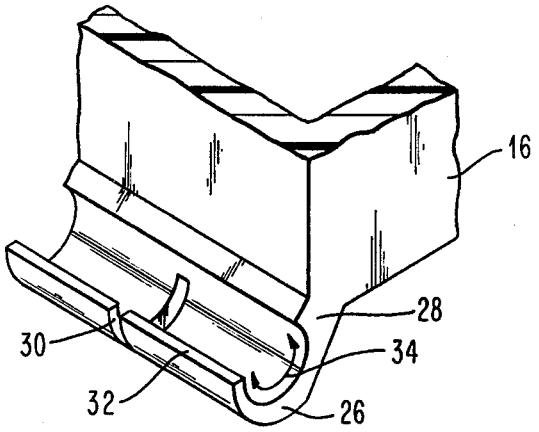
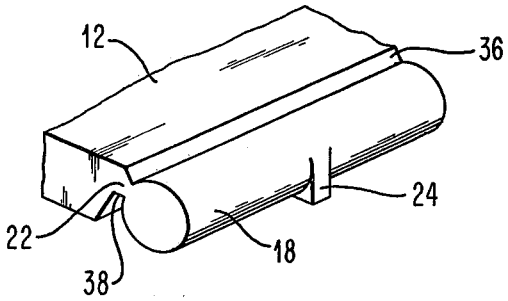
FIG. 4
FIG. 5
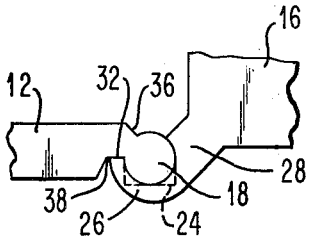
FIG. 6
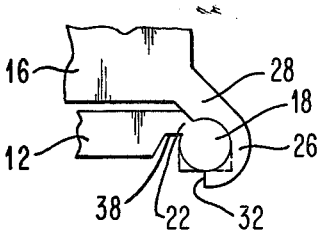

INTEGRAL HINGE STRUCTURE

TECHNICAL FIELD

The present invention relates to hinges and more particularly to an integral hinge structure for connecting a cover to a base.

PRIOR ART

Office products, such as typewriters, and data processing products, such as data entry terminals, commonly have a base with a hinged cover which permits the operator or a service technician to reach the internal parts of the device either to perform maintenance and repair services or to replace consumable supplies, such as typewriter ribbons, journal paper and the like.

The base and the cover have often been made from metal materials and have been connected by metal hinges of various designs. Such hinges invariably include several discrete parts which are fastened to the base and to the lid by sheet metal screws or by the use of conventional techniques, such as welding.

While there has been a trend toward the use of high strength plastics for bases and covers, complex metal hinges are still being used. To provide rigid mounting points for the hinges, special ribs and supports are formed in the molded base and cover members. Conventional fastening techniques are used to fasten the hinge components to the molded parts.

Known prior art hinge structures have a number of drawbacks. The hinges themselves are relatively costly and thus increase the overall cost of the product into which they are incorporated. Moreover, as indicated above, the product sometimes has to be modified or strengthened at attachment points for the hinges, further increasing the product cost. Metal hinges also increase assembly and service costs. The hinges must be fastened to the base and to the cover either before or during assembly and steps must be taken to be sure that the cover is properly aligned relative to the base. These steps take time, which translates into added labor costs.

The metal hinges can become distorted or broken if an operator forces a cover beyond its normal position. In extreme cases, such operator abuse can lead to damage to the base or cover of the unit. The requirement that the hinges be periodically adjusted to maintain correct alignment adds to the service costs for the product.

SUMMARY

The present invention is an integral hinge structure which overcomes many of the problems resulting from the use of prior art metal hinge structures.

In a preferred embodiment, the hinge structure includes a generally cylindrical strip of material extending along one edge of an area to be covered. The cylindrical strip is connected to the remaining material of a first member by an elongated web of material. The second component of the hinge structure is a generally C-shaped strip of material connected to the second or cover member. The arc circumscribed by the C-shaped strip is at least 180°, permitting the strip to be retained by the cylindrical strip of material. At least one of the strips must be made of a slightly resilient material to permit the C-shaped strip to be forced into place.

BRIEF DESCRIPTION OF THE DRAWINGS

While the specification concludes with claims particularly pointing out and distinctly claiming that which is regarded as the present invention, further details and advantages of a preferred embodiment of the invention may be more readily ascertained from the following detailed description when read in conjunction with the accompanying drawings, wherein:

FIG. 3 is a partial perspective view of the C-shaped strip which forms one component of the hinge structure;

FIG. 4 is a partial perspective view of the generally cylindrical strip forming the other component of the hinge structure;

FIG. 5 is an edge view of an assembled hinge with the cover in a closed position; and FIG. 6 is an edge view of an assembled hinge with the cover pivoted to an open position.

DETAILED DESCRIPTION

Figure 1:
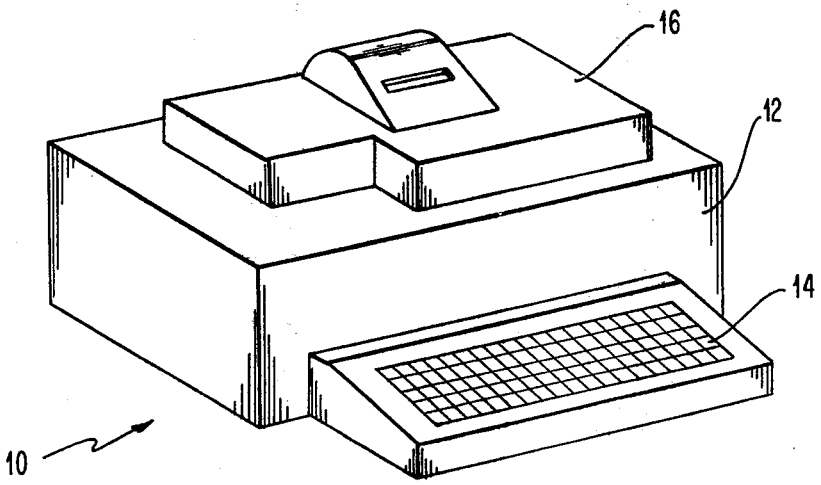
FIG. 1 is a perspective view of a representative device into which the present invention could be incorporated.

Referring now to the drawings and more particularly to FIG. 1, a point of sale terminal 10 is one example of many different kinds of office machines or data processing machines that can make use of the present invention. The terminal 10 includes a base 12, a keyboard 14 and a cover 16 which conceals one or more printers used to create transaction records. As a practical matter, the printer or printers are attached to a frame within the base 12 but protrude through an opening in the top wall of the base to allow an operator to readily replace ink ribbons or paper rolls.

Figure 2:
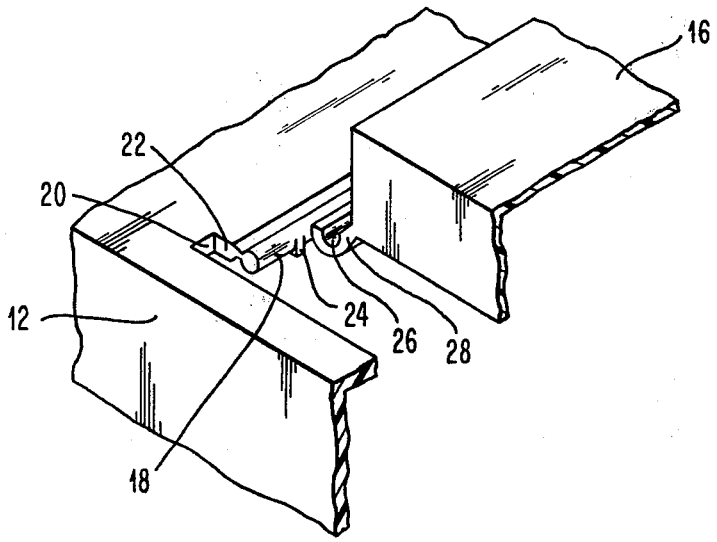
FIG. 2 is a closer view of the hinge area of the device of FIG. 1 with the cover displaced for purposes of illustration.

An integral hinge formed in accordance with the present invention may be used to provide a hinged connection between one edge of the cover 16 and the top wall of the base 12. The components of the hinge structure are shown in somewhat greater detail in FIG. 2 wherein the cover 16 is displaced above and to the right of its normal or attached position to more clearly show the hinge components. One component of the hinge structure is a generally cylindrical strip 18 which is integral with the base 12. The cylindrical strip 18 is parallel to one edge 20 of the printer opening but is spaced from that edge by an elongated web or neck 22. The cylindrical strip 18 carries one or more radial aligning ribs, such as rib 24.

The second major component of the hinge structure is a generally C-shaped strip 26 which is preferably integral with the cover 16. The C-shaped strip 26 is connected to cover 16 by an elongated web or neck 28.

FIG. 3 shows a length of the C-shaped strip in more detail. The strip 26 includes one or more alignment slots 30 for receiving the aligning ribs 24 on the cylindrical strip 18. The wall of the C-shaped strip 26 is relatively thick and terminates in a flat outer edge 32. The angle 34 circumscribed by the inner surface of the C-shaped strip 26 is somewhat greater than 180° and is preferably in the range of 200°–240°.

FIG. 4 shows the cylindrical strip 18 in greater detail. The aligning rib 24 can be seen to be a rectangular extension having two flat outer edges extending tangentially from the surface of the cylindrical strip 18 to a perpendicular corner. A mirror image rib is formed on the opposite or left side of the cylindrical strip 18 and extends toward the neck 22. For reasons which will become apparent later, the upper surface 36 and the lower surface 38 of neck 22 are not parallel to one another.

Referring to FIG. 5, the cover 16 is secured to the base 12 by snapping the C-shaped strip 26 over the cylindrical strip 18. The inner diameter of the C-shaped strip 26 is preferably equal to or somewhat less than the outer diameter of the cylinder 18 to generate movement-inhibiting drag when the cover 16 is pivoted relative to the base 12. By selecting certain materials for cover 16 and base 12, and by controlling the relative diameters of the cylindrical strip 18 and the C-shaped strip 26, enough drag can be created to eliminate any need for counterweights, ordinarily provided to prevent the cover 16 from closing too quickly.

The flat outer end 32 of the strip 26 rests against the flat undersurface 38 of neck 22 to provide a positive stop, limiting clockwise movement of the cover 16. The hinge structure is preferably not expected to carry the entire weight of the cover 16. Cover supporting ledges (not shown) are preferably provided at one or more of the remaining three edges of the opening being covered.

FIG. 6 shows the hinge structure when the cover 16 is pivoted in a counterclockwise direction to a fully open position. In the open position, one surface of neck 28 rests against the upper surface 36 of the neck to provide a positive movement-limiting stop for cover 16. If the cover is forced past this stop position, the C-shaped strip 26 will separate from the cylindrical strip 18 without damage to either. The user can readily reattach the cover 16 to the base 12, relying on the ribs 24 and complementary slots 30 to align the cover on the base.

There are a number of other advantages for the hinge structure described above. The hinge components are formed when the cover 16 and the base 12 are molded. Since the amount of extra material required to make the hinge components is minimal, the hinge components add very little to the product material costs. Assembly of the cover to the base requires no tools since the cover is attached to the base simply by snapping the C-shaped strip on the cover over the cylindrical strip on the base. The aligning ribs 24 on the cylindrical strip 18 and slots 30 on the C-shaped strip 26 align the cover 16 relative to the base 12 during assembly and subsequent use. No alignment procedures or tools are needed.

Moreover, the hinge structure facilitates the design of aesthetically pleasing devices. When the cover is in its closed position, the hinge is concealed. The hinge can also be made self lubricating by proper selection of the plastic materials used for the base and cover. For example, the base may be made of a acrylonitrile butadiene styrene material while the cover is made of a polycarbonate material. Such materials have a self-lubricating characteristic when brought into sliding contact. As indicated earlier, the relative diameters of the cylindrical strip and the C-shaped strip and the angle circumscribed by the C-shaped strip can be varied to control the amount of friction which retards movement of the cover relative to the base. The friction eliminates the need for counterweights. Finally, a good acoustical seal is provided by the uninterrupted, tightly fitting components of the hinge structure.

While there has been described what is considered to be a preferred embodiment of the present invention, variations and modifications of that embodiment may occur to shose skilled in the art once they become aware of the basic concepts of the invention. Therefore, it is intended that the appended claims shall be construed to include not only the preferred embodiment but all such variations and modifications as fall within the true spirit and scope of the invention.

Having thus described my invention, what I claim as new, and desire to secure by Letters Patent is:

1. A hinge structure for providing a concealed, hinged connection between one edge of an inwardly-extending opening in one surface of a base and an adjacent edge of a cover which can be pivoted to a closed position in which it conceals the opening, said hinge structure comprising:

a generally cylindrical strip integral with the base and extending along the one edge thereof within the opening, said strip being spaced from the one edge by an integral web substantially the same length as said cylindrical strip; and a generally C-shaped strip integral with the cover and extending along the adjacent edge thereof, said C-shaped strip being spaced from the cover by an integral web of substantially the same length as said C-shaped strip with the C opening outward and circumscribing an angle of at least 180° to permit the cover to be secured to the base with the C-shaped strip being concealed from view by the overlying cylindrical strip and integral web when the cover is in its closed position.

2. A hinge structure as defined in claim 1 further including means for aligning the cover relative to the side edges of the opening in the base, said aligning means comprising at least one rib protruding transversely from said generally cylindrical strip of material and at least one slot extending transversely through said generally C-shaped strip of material.

3. A hinge structure as defined in claim 2 wherein said generally cylindrical strip of material and said generally C-shaped strip of material are made of materials having self-lubricating characteristics.

4. A hinge structure as defined in claim 3 wherein the materials are dissimilar plastic materials.

5. A hinge structure as defined in claim 1 wherein the upper surface of the web on said cover contacts the upper surface of the web on said base to prevent movement of said cover beyond a normal, fully-open position.

6. A hinge structure as defined in claim 5 wherein the free end of said C-shaped strip is contiguous with the bottom surface of the web on said base when said cover is in its closed position.

7. A hinge structure as defined in claim 6 wherein the inner diameter of the C-shaped strip is slightly less than the outer diameter of said cylindrical strip to produce a movement-retarding drag when the cover is being moved between its open and closed positions.

* * * * *